US006688212B2

(12) United States Patent
Iizuka

(10) Patent No.: US 6,688,212 B2
(45) Date of Patent: Feb. 10, 2004

(54) SWASH PLATE-TYPE COMPRESSORS

(75) Inventor: Jiro Iizuka, Isesaki (JP)

(73) Assignee: Sanden Corporation, Gunma (JP)

( * ) Notice: Subject to any disclaimer, the term of this patent is extended or adjusted under 35 U.S.C. 154(b) by 140 days.

(21) Appl. No.: 10/095,460

(22) Filed: Mar. 13, 2002

(65) Prior Publication Data

US 2002/0134232 A1 Sep. 26, 2002

(30) Foreign Application Priority Data

Mar. 26, 2001 (JP) ..... P2001-086699

(51) Int. Cl.[7] ..... F01B 3/00

(52) U.S. Cl. ..... 92/71; 92/12.2; 417/269; 74/60

(58) Field of Search ..... 92/71, 12.2; 417/269; 74/60

(56) References Cited

U.S. PATENT DOCUMENTS

| | | | | | |
|---|---|---|---|---|---|
| 4,662,267 | A | * | 5/1987 | Kaku et al. | 92/71 |
| 4,734,014 | A | * | 3/1988 | Ikeda et al. | 417/269 |
| 5,483,867 | A | | 1/1996 | Ikeda et al. | |
| 5,495,789 | A | | 3/1996 | Ogura et al. | |
| 5,896,803 | A | * | 4/1999 | Sugawara et al. | 92/12.2 |
| 5,950,480 | A | | 9/1999 | Fukushima | |
| 5,950,521 | A | | 9/1999 | Fukushima et al. | |
| 6,024,010 | A | * | 2/2000 | Kato et al. | 92/71 |
| 6,098,520 | A | | 8/2000 | Terauchi | |
| 6,168,389 | B1 | | 1/2001 | Fukushima | |
| 6,276,905 | B1 | | 8/2001 | Yoshitaka | |
| 6,371,007 | B1 | | 4/2002 | Ootsuki | |
| 6,477,938 | B1 | * | 11/2002 | Nakayama et al. | 92/71 |

FOREIGN PATENT DOCUMENTS

| | | |
|---|---|---|
| JP | 75259 | 2/1995 |
| JP | 11050958 | 2/1999 |
| JP | 2000170653 | 6/2000 |

* cited by examiner

*Primary Examiner*—Edward K. Look
*Assistant Examiner*—Igor Kershteyn
(74) *Attorney, Agent, or Firm*—Baker Botts L.L.P.

(57) ABSTRACT

A swash plate-type compressor includes a cylinder block having a plurality of cylinder bores formed therethrough, a drive shaft rotatably supported by the cylinder block, and a swash plate rotatably mounted on the drive shaft. The compressor also includes a plurality of pistons, each of which is positioned within one of the cylinder bores and reciprocates within the cylinder bore. Each of the pistons includes a substantially semispherical cavity formed at an end of the piston. The compressor further includes a pair of shoes positioned between each of the pistons and the swash plate. Each shoe includes a substantially flat surface adapted to be in slidable contact with the swash plate, and a substantially semispherical portion adapted to rotatably engage the semispherical cavity of the piston. Moreover, the semispherical portion of the shoe includes a saddle portion or a groove having a first curved portion and a non-circular perimeter.

11 Claims, 7 Drawing Sheets

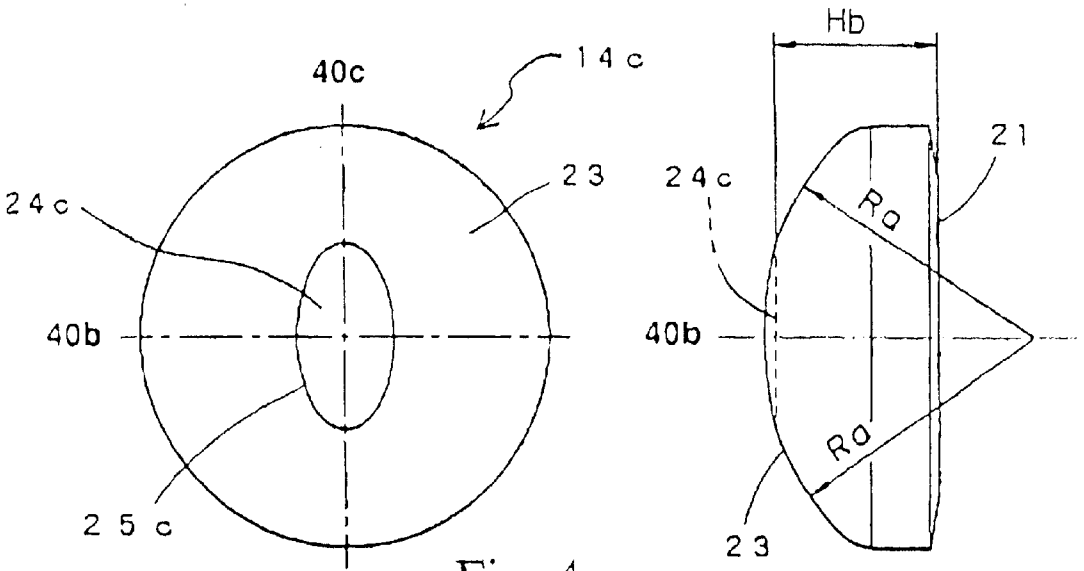
Fig. 4a
Fig. 4b
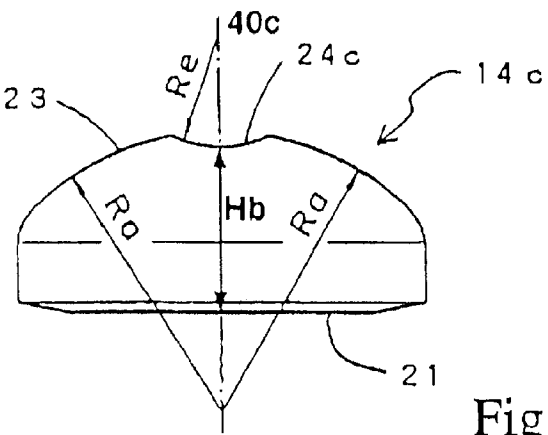
Fig. 4c

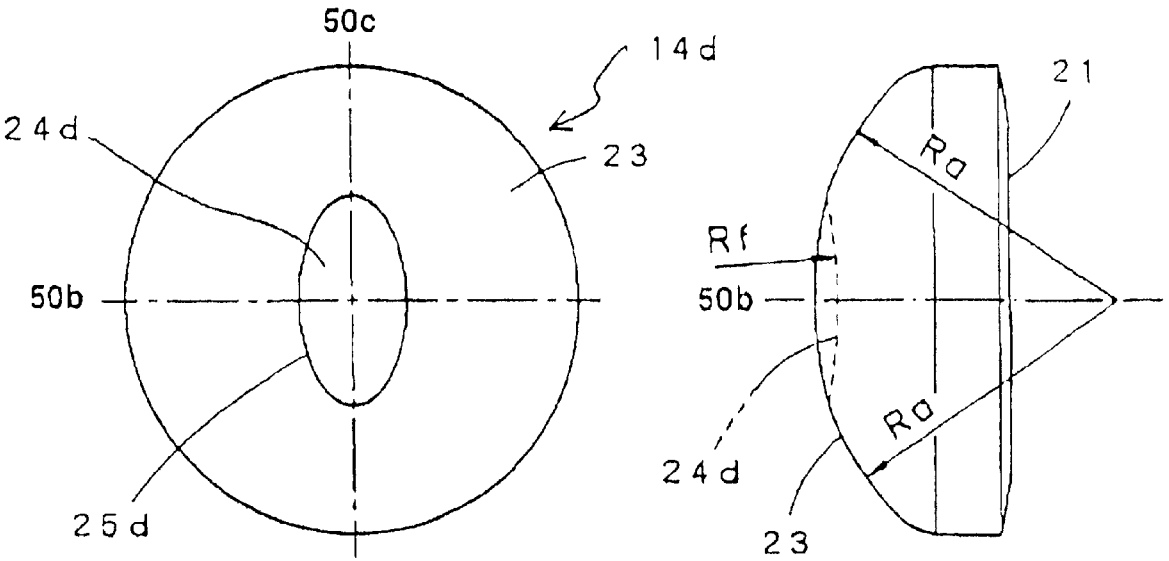
Fig. 5a
Fig. 5b
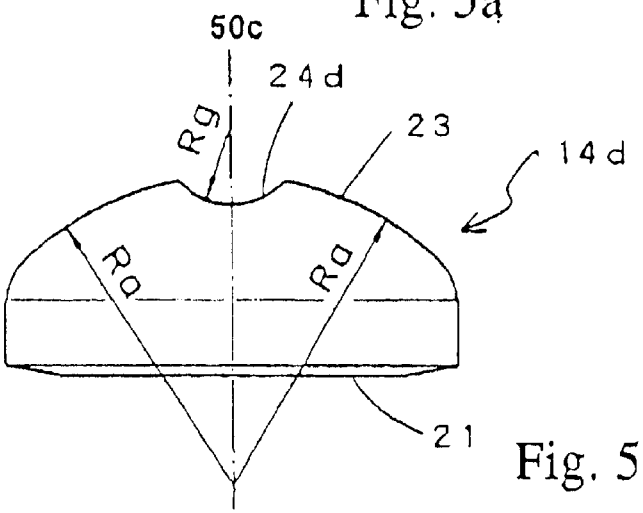
Fig. 5c

SWASH PLATE-TYPE COMPRESSORS

BACKGROUND OF THE INVENTION

1. Field of the Invention

The invention relates generally to swash plate-type compressors. More particularly, the invention relates to swash plate-type compressors having a shoe positioned between a swash plate and a piston.

2. Description of Related Art

Referring to FIG. 6, a known, swash plate-type compressor 1 is depicted. Compressor 1 includes a cylinder block 2, a front housing 3, a cylinder head 4, and drive shaft 5. Cylinder block 2, front housing 3, and cylinder head 4 may be fixably attached by a plurality of bolts 15. A crank chamber 6 may be formed between cylinder block 2 and front housing 3, and drive shaft 5 may be rotatably supported by cylinder block 2 and front housing 3 via a pair of bearings 16*a* and 16*b* mounted in front housing 3 and cylinder block 2, respectively. A swash plate 8 may be positioned inside crank chamber 6, and also may be slidably mounted to drive shaft 5. Swash plate 8 may include an arm 81 rotatably connected to an arm 71 of a rotor 7, such that swash plate 8 rotates substantially simultaneously with drive shaft 5. The connection between arm 81 and arm 71 also allows the inclination angle of swash plate 8 to vary relative to drive shaft 5. Moreover, a suction chamber 9 and a discharge chamber 10 may be formed in cylinder head 4, and an electromagnetic clutch 11 for engaging and disengaging drive shaft 5 may be rotatably supported by front housing 3. Further, a drive belt (not shown) may be used to transfer motion from a crankshaft of an engine of a vehicle (not shown) to electromagnetic clutch 11.

Compressor 1 also may include a plurality of cylinder bores 12 formed in cylinder block 2, and a plurality of pistons 13 positioned within a corresponding cylinder bore 12. Cylinder bores 12 may be arranged radially with respect to a central axis of cylinder block 2, and pistons 13 may reciprocate independently within corresponding cylinder bore 12. Each piston 13 also may be connected to swash plate 8 via a pair of shoes 14. Specifically, each shoe 14 may comprise a substantially flat surface and a semispherical portion. The substantially flat surface of shoe 14 may be in slidable contact with swash plate 8, and the semispherical portion of shoe 14 may rotatably engage a semispherical cavity of piston 13. As such, shoes 14 may convert the rotation of swash plate 8 into the reciprocation of pistons 13 within corresponding cylinder bores 12. Specifically, when the inclination angle of swash plate 8 relative to drive shaft 5 varies, shoes 14 may maintain rotational engagement with piston 13 and also may maintain sliding contact with swash plate 8, which may allow pistons 13 to reciprocate within corresponding cylinder bores 12. When each piston 13 reciprocates, corresponding shoes 14 may rotate about their shared center axis within the semispherical cavity of piston 13.

Because of the rotation of shoe 14 within the semispherical cavity of piston 13, a lubricant, e.g., a lubricating oil, may be employed in order to reduce or eliminate friction between shoe 14 and piston 13. In order to more readily supply the lubricant between the engaging portions of shoe 14 and piston 13, the semispherical portion of shoe 14 may have a substantially flat or a convex, semispherical portion formed at a piston-side of shoe 14. The substantially flat or convex, semispherical portion of shoe 14 may have a radius of curvature which is greater than a radius of curvature of a seat portion of the semispherical cavity of piston 13. As such, a gap or a clearance may be created between the substantially flat or convex, semispherical portion of shoe 14 and the semispherical cavity of piston 13. Examples of such known shoes are described in Japanese (Examined) Utility Model Publication No. H07-5259, Japanese (Unexamined) Patent Publication No. H11-50958, and Japanese (Unexamined) Patent Publication No. 2000-170653. Nevertheless, with these known shoes, the substantially flat or convex, semispherical portion formed at the piston-side of the shoe may deform during manufacture of the shoe because of a wear reduction heat treatment applied to the shoe during manufacture. As such, it may be difficult to accurately maintain the shape of the substantially flat or convex, semispherical portion formed at the piston-side of the shoe. Specifically, during manufacture, the perimeter of the substantially flat or convex, semispherical portion formed at the piston-side of the shoe may become a circular-shaped perimeter.

During operation, when the pistons reciprocate within the cylindrical bores, the seat portion of the semispherical cavity of the piston engages the substantially flat or convex, semispherical portion of the shoe. Nevertheless, because the substantially flat or convex portion formed at the piston-side of the shoe has a circular-shaped perimeter, the seat portion of the semispherical cavity of the piston substantially seals the substantially flat or convex portion of the shoe during a rotation of the shoe. As such, the amount of lubricant distributed from the substantially flat or convex portion of the shoe to other portions of the shoe engaging the seat portion of the semispherical cavity of the piston may be reduced. Consequently, friction between the shoe and the piston may increase, and noise associated with such friction also may increase.

SUMMARY OF THE INVENTION

Therefore a need has arisen for swash plate-type compressors having shoes which overcome these and other shortcomings of the related art. A technical advantage of the present invention is that a saddle or groove formed at a piston-side of a shoe may have a non-circular-shaped perimeter, e.g., an oval-shaped perimeter. As such, when a seat portion of a semispherical cavity of a piston engages the saddle portion or the groove of the shoe, the piston may not seal the saddle portion or the groove of the shoe during a rotation of the shoe. Consequently, friction between the shoe and the piston may be reduced or eliminated without increasing the size of the gap or the clearance between the shoe and the piston, and noise associated with such friction also may be reduced or eliminated.

According to an embodiment of the present invention, a swash plate-type compressor is described. The compressor comprises a cylinder block having a plurality of cylinder bores formed therethrough, a drive shaft rotatably supported by the cylinder block, and a swash plate rotatably mounted on the drive shaft. The compressor also comprises a plurality of pistons, each of which is positioned within one of the cylinder bores and reciprocates within the cylinder bore. Each of the pistons comprises a substantially semispherical cavity formed at an end of the piston. The compressor further comprises a pair of shoes positioned between each of the pistons and the swash plate. Each shoe comprises a substantially flat surface adapted to be in slidable contact with the swash plate, and a substantially semispherical portion adapted to rotatably engage the semispherical cavity of the piston. Moreover, the semispherical portion of the shoe comprises a saddle portion or a groove having a first curved portion and a non-circular perimeter.

Other objects, features, and advantages of the present invention will be apparent to persons of ordinary skill in the art in view of the following detailed description of the invention and the accompanying drawings.

BRIEF DESCRIPTION OF THE DRAWINGS

For a more complete understanding of the present invention, the needs satisfied thereby, and the objects, features, and advantages thereof, reference now is made to the following descriptions taken in connection with the accompanying drawings.

FIG. 4*a* is a plan view of a shoe according to a third embodiment of the present invention.

FIG. 4*b* is a side view of the shoe of FIG. 4*a* according to the third embodiment of the present invention.

FIG. 4*c* is a front view of the shoe of FIG. 4*a* according to the third embodiment of the present invention.

FIG. 5*a* is a plan view of a shoe according to a fourth embodiment of the present invention.

FIG. 5*b* is a side view of the shoe of FIG. 5*a* according to the fourth embodiment of the present invention.

FIG. 5*c* is a front view of the shoe of FIG. 5*a* according to the fourth embodiment of the present invention.

DETAILED DESCRIPTION OF PREFERRED EMBODIMENTS

Preferred embodiments of the present invention and their advantages may be understood by referring to FIGS. 1–5 and 7, like numerals being used for like corresponding parts in the various drawings.

Figure 7:
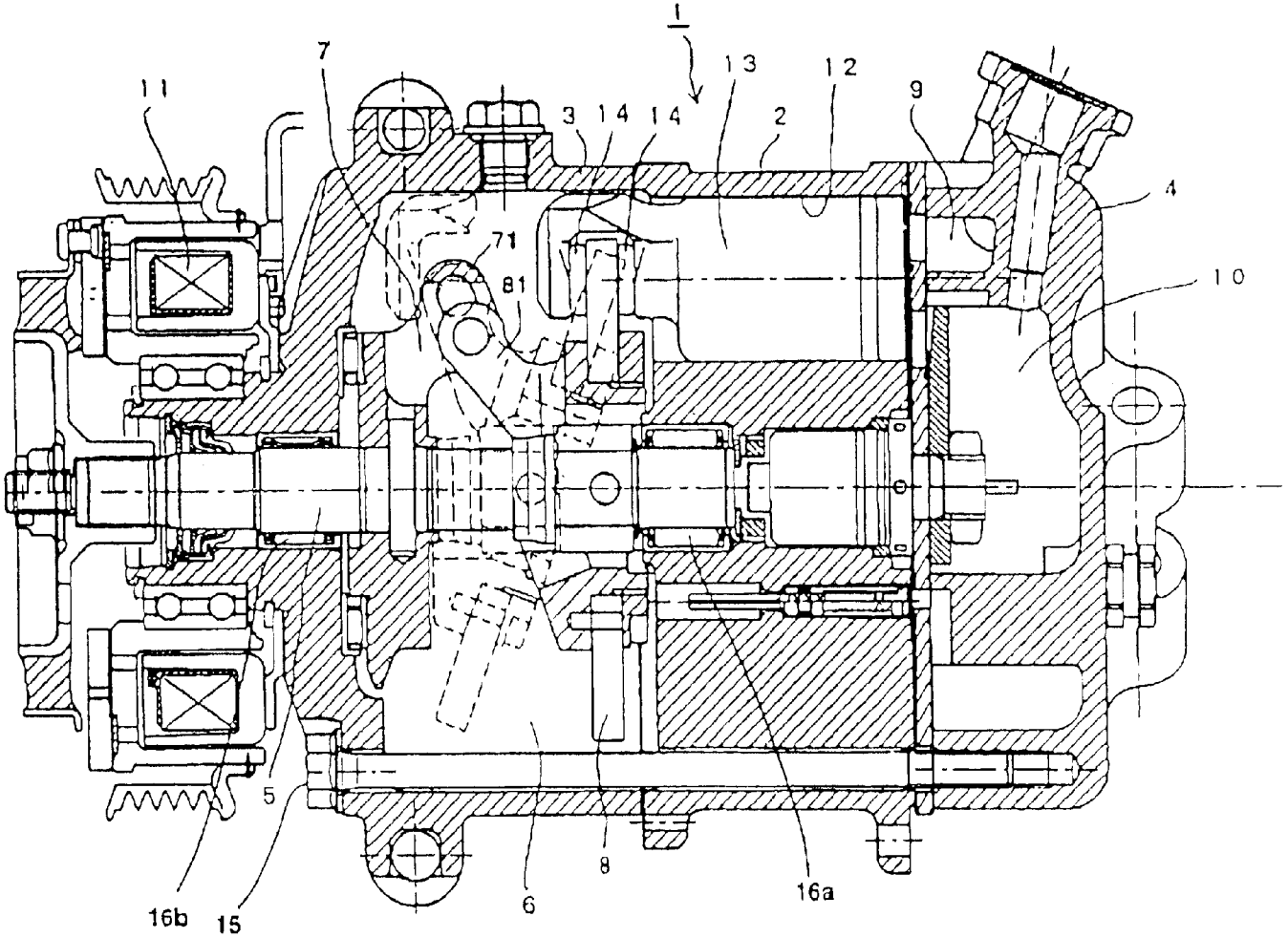
FIG. 7 is a cross-sectional view of a swash plate-type compressor according to embodiments of the present invention.

Referring to FIG. 7, a swash plate-type compressor 100 according to embodiments of the present invention is depicted. Compressor 100 may comprise a cylinder block 2, a front housing 3, a cylinder head 4, and drive shaft 5. Cylinder block 2, front housing 3, and cylinder head 4 may be fixably attached by a plurality of bolts 15. A crank chamber 6 may be formed between cylinder block 2 and front housing 3, and drive shaft 5 may be rotatably supported by cylinder block 2 and front housing 3 via a pair of bearings 16*a* and 16*b* mounted in front housing 3 and cylinder block 2, respectively. A swash plate 8 may be positioned inside crank chamber 6, and also may be slidably mounted to drive shaft 5. Swash plate 8 may comprise and arm 81 rotatably connected to an arm 71 of a rotor 7, such that swash plate 8 rotates substantially simultaneously with drive shaft 5. The connection between arm 81 and arm 71 also allows the inclination angle of swash plate 8 to vary relative to drive shaft 5. Moreover, a suction chamber 9 and a discharge chamber 10 may be formed in cylinder head 4, and an electromagnetic clutch 11 for engaging and disengaging drive shaft 5 may be rotatably supported by front housing 3. Further, a drive belt (not shown) may be used to transfer motion from a crankshaft of an engine of a vehicle (not shown) to electromagnetic clutch 11.

Figure 1:
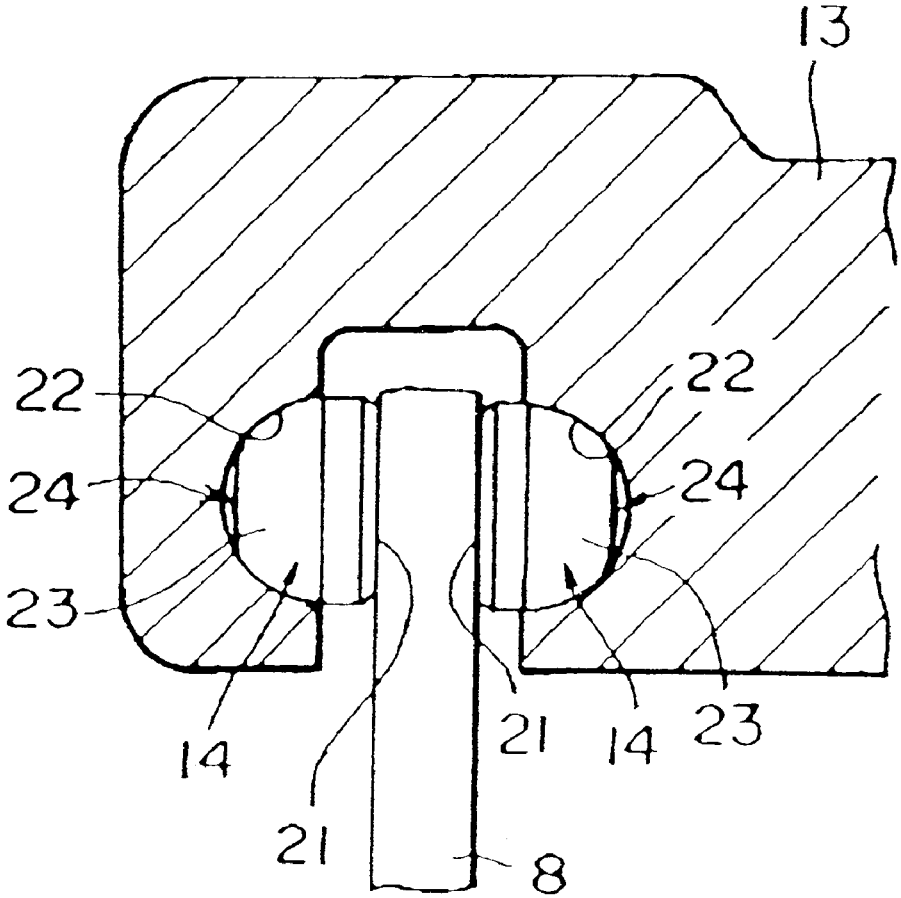
FIG. 1 is a cross-sectional view of a piston, a pair of shoes, and a swash plate according to embodiments of the present invention.

Referring to FIGS. 1 and 7, compressor 100 also may comprise a plurality of cylinder bores 12 formed in cylinder block 2, and a plurality of pistons 13, each of which is positioned within a corresponding cylinder bore 12. Cylinder bores 12 may be arranged radially with respect to a center axis of cylinder block 2, and pistons 13 may reciprocate independently within corresponding cylinder bore 12. Each piston 13 also may be connected to swash plate 8 via a pair of shoes 14. Specifically, each shoe 14 may comprise a substantially flat surface 21 and a substantially semispherical portion 23. Substantially flat surface 21 of shoe 14 may be in slidable contact with swash plate 8, and semispherical portion 23 of shoe 14 may rotatably engage a substantially semispherical cavity 22 of piston 13. As such, shoes 14 may convert the rotation of swash plate 8 into the reciprocation of pistons 13 within corresponding cylinder bore 12. Specifically, when the inclination angle of swash plate 8 relative to drive shaft 5 varies, shoes 14 may maintain rotational engagement with piston 13 and also may maintain sliding contact with swash plate 8, which may allow pistons 13 to reciprocate within corresponding cylinder bore 12. When each piston 13 reciprocates, corresponding shoes 14 may rotate about their central axes within semispherical cavity 22 of piston 13.

Referring again to FIG. 1, because of the rotation of shoe 14 within semispherical cavity 22 of piston 13, a lubricant, e.g., a lubricating oil, may be employed in order to reduce or eliminate friction between shoe 14 and piston 13. In order to more readily supply the lubricant between the engaging portions of shoe 14 and piston 13, semispherical portion 23 of shoe 14 may comprise a saddle portion or a groove 24 formed at a piston-side of shoe 14 adapted to create a gap or a clearance between semispherical portion 23 of shoe 14 and semispherical cavity 22 of piston 13.

Figure 2B:
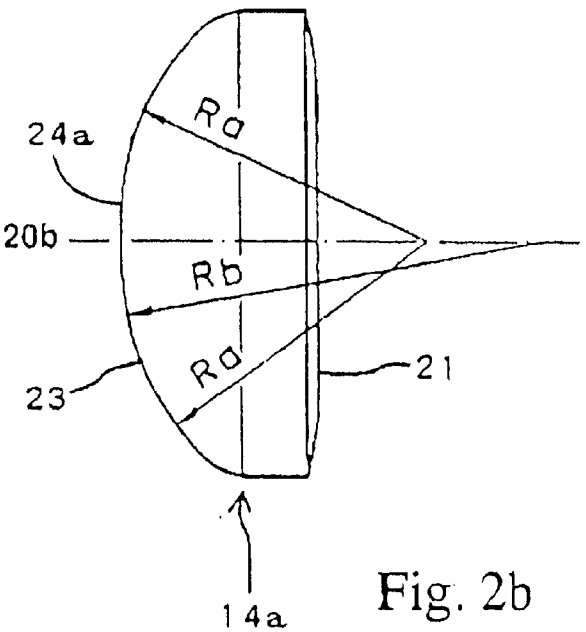
FIG. 2*b* is a side view of the shoe of FIG. 2*a* according to the first embodiment of the present invention.
Figure 2A:
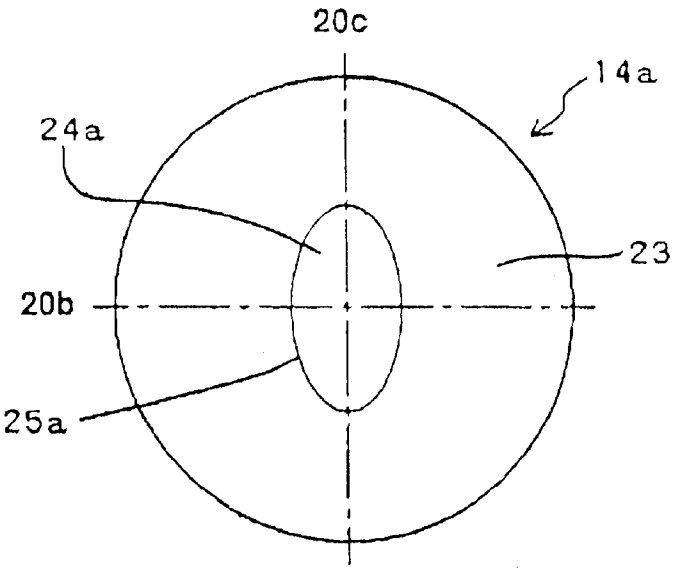
FIG. 2*a* is a plan view of a shoe according to a first embodiment of the present invention.
Figure 2C:
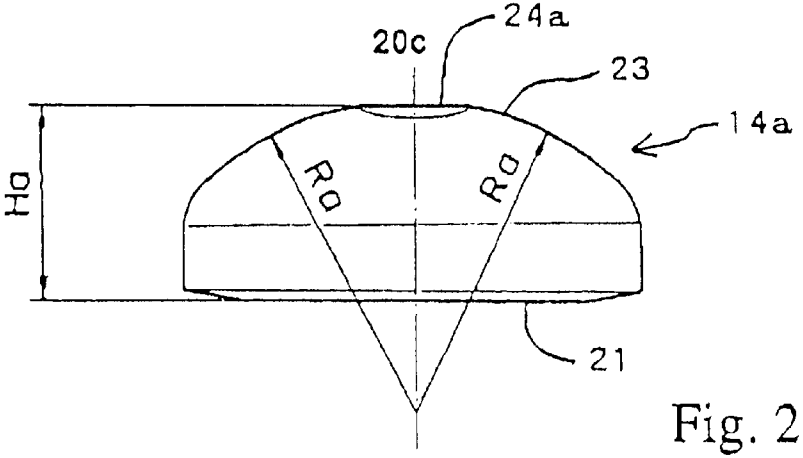
FIG. 2*c* is a front view of the shoe of FIG. 2*a* according to the first embodiment of the present invention.

Referring to FIGS. 2*a*–*c*, a shoe 14*a* having a saddle portion with a non-circular-shaped perimeter according to a first embodiment of the present invention is described in detail. In this embodiment, semispherical portion 23 of shoe 14*a* may have a radius of curvature (Ra) and may comprise a saddle portion 24*a* formed concentric with semispherical portion 23. Saddle portion 24*a* may be adapted to receive a lubricant, e.g., lubricating oil, and may be formed at a piston-side of shoe 14*a*. The piston-side of shoe 14*a* may be cut, such that shoe 14*a* has a height (Ha) between substantially flat surface 21 and the peak of saddle portion 24*a*. For example, the piston-side of shoe 14*a* may be cut by a side surface of a known end mill, various known embossing methods, or the like. Moreover, saddle portion 24*a* may have first central axis 20*b* and a second central axis 20*c* perpendicular to first central axis 20*b*, and also may comprise a first curved portion having a first radius of curvature (Rb) greater than radius of curvature (Ra) of semispherical portion 23. Specifically, the first curved portion may curve in a direction parallel to first central axis 20*b* and perpendicular to second central axis 20*c*. In this embodiment, saddle portion 24*a* may have a non-circular shaped perimeter, e.g., an oval-shaped perimeter 25*a*, and also may have the shape of a portion of a cylinder or a portion of a circle.

Figure 3B:
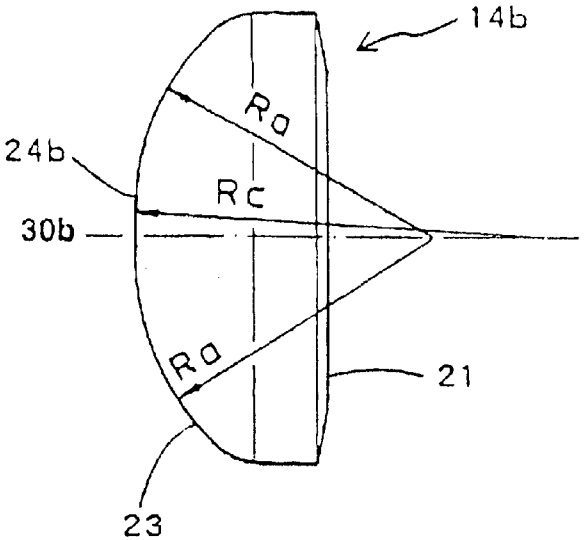
FIG. 3*b* is a side view of the shoe of FIG. 3*a* according to the second embodiment of the present invention.
Figure 3A:
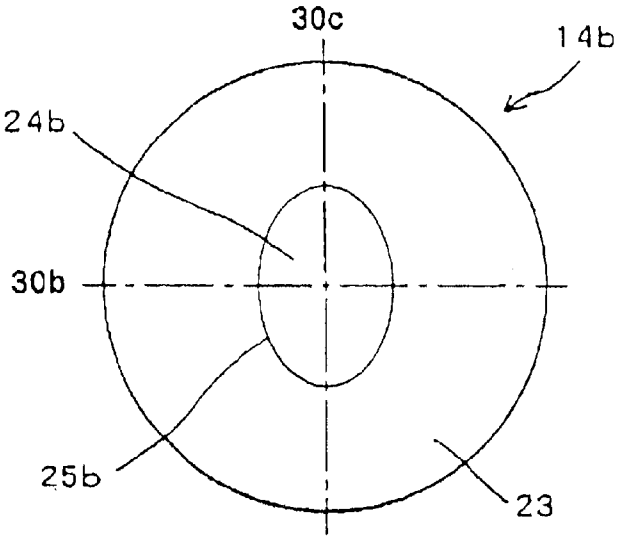
FIG. 3*a* is a plan view of a shoe according to a second embodiment of the present invention.
Figure 3C:
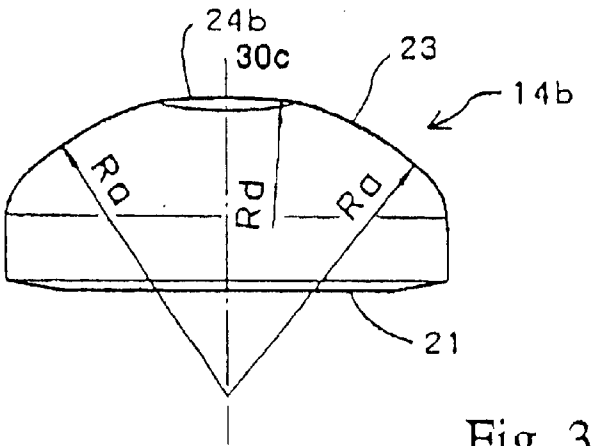
FIG. 3*c* is a front view of the shoe of FIG. 3*a* according to the second embodiment of the present invention.
Figure 6:
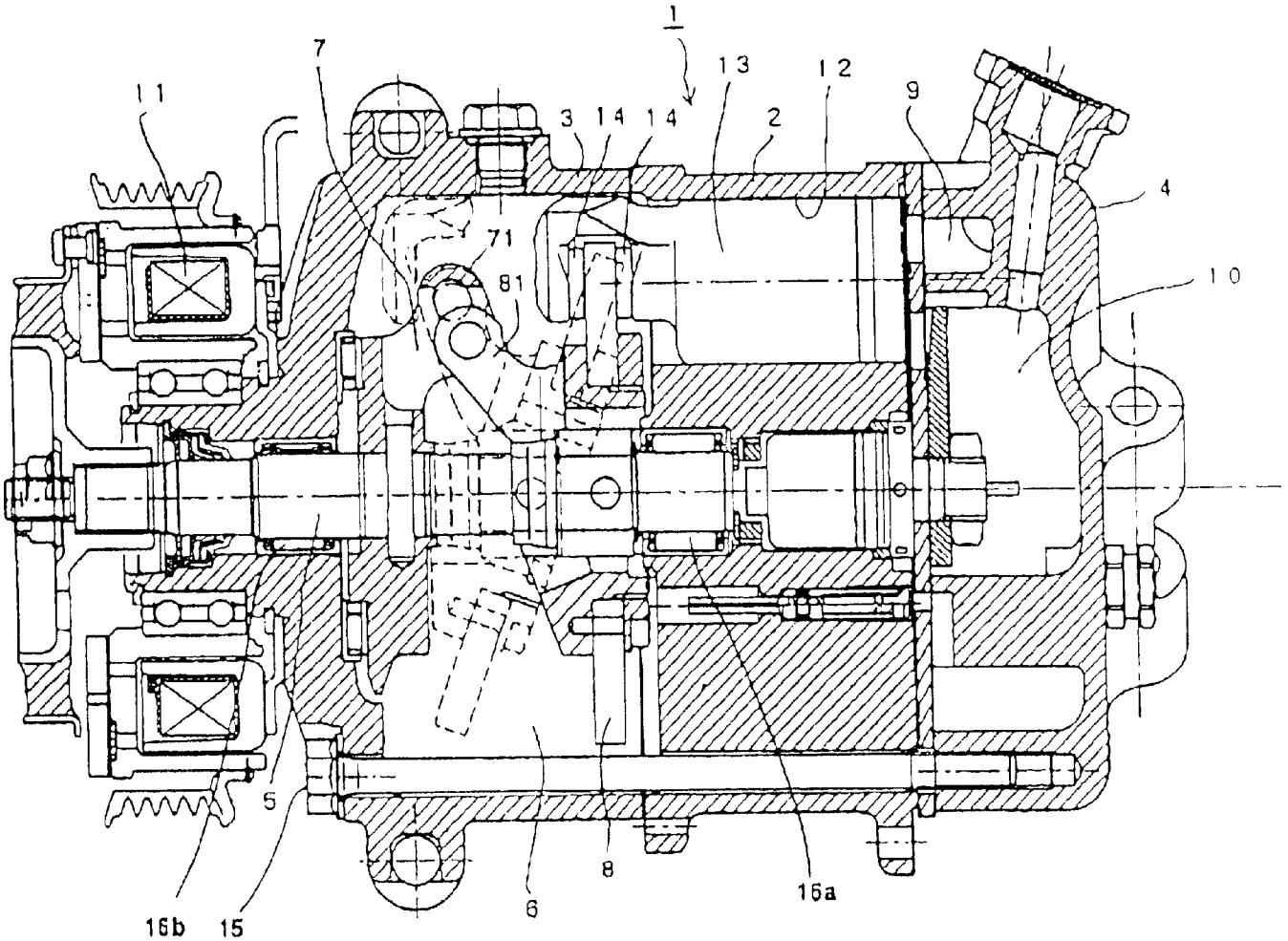
Fig. 6 (Prior Art)
FIG. 6 is a cross-sectional view of a known, swash plate-type compressor.

Referring to FIGS. 3*a–c*, a shoe 14*b* having a saddle portion with a non-circular-shaped perimeter according to a second embodiment of the present invention is described in detail. The features and advantages of the second embodiment are similar to the features and advantages of the first embodiment. Therefore, the features and advantages of the first embodiment are not further discussed with respect to the second embodiment. In this embodiment, semispherical portion 23 of shoe 14*b* may have a radius of curvature (Ra) and may comprise a saddle portion 24*b* formed concentric with semispherical portion 23. Saddle portion 24*b* may be adapted to receive a lubricant, e.g., lubricating oil, and may be formed at a piston-side of shoe 14*b*. The piston-side of shoe 14*b* may be cut by a side surface of a known end mill, various known embossing methods, or the like. Moreover, saddle portion 24*b* may have a first central axis 30*b* and a second central axis 30*c* perpendicular to first central axis 30*b*. Saddle portion 24*b* may comprise a first curved portion having a first radius of curvature (Rc). The first curved portion may curve in a direction parallel to first central axis 30*b* and perpendicular to second central axis 30*c*. Similarly, saddle portion 24*b* also may comprise a second curved portion having a second radius of curvature (Rd). The second curved portion may curve in a direction parallel to second central axis 30*c* and perpendicular to first central axis 30*b*. As such, the first curved portion and the second curved portion may intersect, and the intersection of the first curved portion and the second curved portion may form a right angle. In one embodiment, first radius of curvature (Rc) may not be equal to second radius of curvature (Rd). For example, first radius of curvature (Rc) may be greater than radius of curvature (Ra) of semispherical portion 23, and second radius of curvature (Rd) may be greater than first radius of curvature (Rc). In a modification of this embodiment, second radius of curvature (Rd) may be greater than radius of curvature (Ra) of semispherical portion 23, and first radius of curvature (Rc) may be greater than second radius of curvature (Rd). In any of these embodiments, saddle portion 24*b* may have a non-circular shaped perimeter, e.g., an oval-shaped perimeter 25*b*, and also may have the shape of a portion of a cylinder or a portion of a circle.

Referring to FIGS. 4*a–c*, a shoe 14*c* having a groove with a non-circular-shaped perimeter according to a third embodiment of the present invention is described in detail. The features and advantages of the third embodiment are similar to the features and advantages of the foregoing embodiments. Therefore, the features and advantages of the foregoing embodiments are not further discussed with respect to the third embodiment. In this embodiment, semispherical portion 23 of shoe 14*c* may have a radius of curvature (Ra) and may comprise a groove 24*c* formed concentric with semispherical portion 23. Groove 24*c* may be adapted to receive a lubricant, e.g., lubricating oil, and may be formed at a piston-side of shoe 14*c*. The piston-side of shoe 14*c* may be cut, such that shoe 14*c* has a height (Hb) between substantially flat surface 21 and the base of groove 24*c*. For example, the piston-side of shoe 14*c* may be cut by a side surface of a known end mill, various known embossing methods, or the like. Moreover, groove 24*c* may have first central axis 40*b* and a second central axis 40*c* perpendicular to first central axis 40*b*, and also may comprise a first curved portion having a first radius of curvature (Re) greater than radius of curvature (Ra) of semispherical portion 23. Specifically, the first curved portion may curve in a direction parallel to second central axis 40*c* and perpendicular to first central axis 40*b*. In this embodiment, groove 24*c* may have a noncircular shaped perimeter, e.g., an oval-shaped perimeter 25*c*, and also may have the shape of a portion of a cylinder or a portion of a circle.

Referring to FIGS. 5*a–c*, a shoe 14*d* having a groove with a non-circular-shaped perimeter according to a fourth embodiment of the present invention is described in detail. The features and advantages of the fourth embodiment are similar to the features and advantages of the foregoing embodiments. Therefore, the features and advantages of the foregoing embodiments are not further discussed with respect to the fourth embodiment. In this embodiment, semispherical portion 23 of shoe 14*d* may have a radius of curvature (Ra) and may comprise a groove 24*d* formed concentric with semispherical portion 23. Groove 24*d* may be adapted to receive a lubricant, e.g., lubricating oil, and may be formed at a piston-side of shoe 14*d*. The piston-side of shoe 14*d* may be cut by a side surface of a known end mill, various known embossing methods, or the like. Moreover, groove 24*d* may have a first central axis 50*b* and a second central axis 50*c* perpendicular to first central axis 50*b*. Groove 24*d* may comprise a first curved portion having a first radius of curvature (Rg) and curving in a direction parallel to second central axis 50*c* and perpendicular to first central axis 50*b*. Similarly, groove 24*d* also may comprise a second curved portion having a second radius of curvature (Rf) and curving in a direction parallel to first central axis 50*b* and perpendicular to second central axis 50*c*. As such, the first curved portion and the second curved portion may intersect, and the intersection of the first curved portion and the second curved portion may form a right angle. In one embodiment, first radius of curvature (Rg) may not be equal to second radius of curvature (Rf). For example, first radius of curvature (Rg) may be greater than radius of curvature (Ra) of semispherical portion 23, and second radius of curvature (Rf) may be greater than first radius of curvature (Rg). In a modification of this embodiment, second radius of curvature (Rf) may be greater than radius of curvature (Ra) of semispherical portion 23, and first radius of curvature (Rg) may be greater than second radius of curvature (Rf). In any of these embodiments, groove 24*d* may have a noncircular shaped perimeter, e.g., an oval-shaped perimeter 25*d*, and also may have the shape of a portion of a cylinder or a portion of a circle.

In any of the foregoing embodiments, when each of pistons 13 reciprocate within corresponding cylindrical bore 12, a seat portion of semispherical cavity 22 of piston 13 engages semispherical portion 23 of the shoe 14. Nevertheless, because saddle portion or groove 24 formed at the piston-side of shoe 14 has a non-circular-shaped perimeter, e.g., an oval-shaped perimeter, the seat portion of semispherical cavity 22 of piston 13 may not seal saddle portion or groove 24 of shoe 14 during a rotation of shoe 14. As such, the amount of lubricant distributed from saddle portion or groove 24 of shoe 14 to other portions of shoe 14 engaging the seat portion of semispherical cavity 22 of piston 13 may increase without increasing the size of the gap or the clearance between shoe 14 and piston 13. Consequently, friction between shoe 14 and piston 13 may decrease or may be eliminated, and noise associated with such friction also may decrease or may be eliminated. Moreover, the curved surfaces of saddle portion or groove 24 of shoe 14 may not readily deform during application of the anti-wear heat treatment.

While the invention has been described in connection with preferred embodiments, it will be understood by those of ordinary skill in the art that other variations and modifications of the preferred embodiments described above may be made without departing from the scope of the invention. Other embodiments will be apparent to those of ordinary skill in the art from a consideration of the specification or practice of the invention disclosed herein.

What is claimed is:

1. A swash plate-type compressor comprising:

a cylinder block having a plurality of cylinder bores formed therethrough;

a drive shaft rotatably supported by said cylinder block;

a swash plate rotatably mounted on said drive shaft;

a plurality of pistons, wherein each of said pistons is positioned within one of said cylinder bores and reciprocates within said cylinder bore, wherein each of said pistons comprises a substantially semispherical cavity formed at an end of said piston;

a pair of shoes positioned between each of said pistons and said swash plate, wherein each of said shoes comprises:

a substantially flat surface adapted to be in slidable contact with said swash plate; and a substantially semispherical portion adapted to rotatably engage said semispherical cavity of said piston, wherein said semispherical portion of said shoe comprises a saddle portion formed at a piston-side of said shoe, wherein said saddle portion comprises a first curved portion and a non-circular perimeter.

2. The compressor of claim 1, wherein said first curved portion of said saddle portion has a first radius of curvature and the shape of a portion of a cylinder, wherein said first radius of curvature is greater than a radius of curvature of said semispherical portion of said shoe.

3. The compressor of claim 1, wherein said first curved portion of said saddle portion has a first radius of curvature and the shape of a portion of a circle, wherein said first radius of curvature is greater than a radius of curvature of said semispherical portion of said shoe.

4. The compressor of claim 3, wherein said saddle portion further comprises a second curved portion having a second radius of curvature, wherein said first radius of curvature is not equal to said second radius of curvature and an intersection of said first curved portion and said second curved portion forms a right angle.

5. The compressor of claim 1, wherein said saddle portion is adapted to engage said semispherical cavity of said piston.

6. The compressor of claim 1, wherein a gap formed between said saddle portion and said semispherical cavity of said piston is adapted to receive a lubricant.

7. A swash plate-type compressor comprising:

a cylinder block having a plurality of cylinder bores formed therethrough;

a drive shaft rotatably supported by said cylinder block;

a swash plate rotatably mounted on said drive shaft;

a plurality of pistons, wherein each of said pistons is positioned within one of said cylinder bores and reciprocates within said cylinder bore, wherein each of said pistons comprises a substantially semispherical cavity formed at an end of said piston;

a pair of shoes positioned between each of said pistons and said swash plate, wherein each of said shoes comprises:

a substantially flat surface adapted to be in slidable contact with said swash plate; and a substantially semispherical portion adapted to rotatably engage said semispherical cavity of said piston, wherein said semispherical portion of said shoe comprises a groove formed at a piston-side of said shoe, wherein said groove comprises a first curved portion and a non-circular perimeter.

8. The compressor of claim 7, wherein said first curved portion of said groove has a first radius of curvature and the shape of a portion of a cylinder, wherein said first radius of curvature is greater than a radius of curvature of said semispherical portion of said shoe.

9. The compressor of claim 7, wherein said first curved portion of said groove has a first radius of curvature and the shape of a portion of a circle, wherein said first radius of curvature is greater than a radius of curvature of said semispherical portion of said shoe.

10. The compressor of claim 9, wherein said groove further comprises a second curved portion having a second radius of curvature, wherein said first radius of curvature is not equal to said second radius of curvature and an intersection of said first curved portion and said second curved portion forms a right angle.

11. The compressor of claim 7, wherein a gap formed between said groove and said semispherical cavity of said piston is adapted to receive a lubricant.

* * * * *